United States Patent [19]

Coutu, Sr.

[11] 4,443,988

[45] Apr. 24, 1984

[54] INSULATED BUILDING PANEL

[75] Inventor: Walter H. Coutu, Sr., Acton, Mass.

[73] Assignee: Atlas Insulation Company, Inc., Ayer, Mass.

[21] Appl. No.: 307,806

[22] Filed: Oct. 2, 1981

[51] Int. Cl.[3] ..... E04B 1/00; E04B 5/00; E04B 7/00

[52] U.S. Cl. ..... 52/309.9; 52/309.2; 52/586

[58] Field of Search ..... 52/309.7, 309.9, 309.14, 52/309.16, 586, 286, 309.2

[56] References Cited

U.S. PATENT DOCUMENTS

| | | | |
|---|---|---|---|
| 213,035 | 3/1879 | Boyd . | |
| 374,545 | 12/1887 | LeGros . | |
| 1,126,927 | 2/1915 | Williams | 52/586 X |
| 1,991,701 | 2/1935 | Roman | 52/586 X |
| 2,115,270 | 4/1938 | Leash . | |
| 2,961,478 | 11/1960 | Burns | 52/286 X |
| 3,074,123 | 1/1963 | Gartrell | 52/586 |
| 3,230,681 | 1/1966 | Allen et al. | 52/309.9 |
| 3,239,986 | 3/1966 | Russell . | |
| 3,339,329 | 9/1967 | Berg . | |
| 3,545,154 | 12/1970 | Bobzin et al. . | |
| 3,599,385 | 8/1971 | LaRue . | |
| 3,775,921 | 12/1973 | Avera . | |

FOREIGN PATENT DOCUMENTS

| | | | |
|---|---|---|---|
| 2010120 | 11/1971 | Fed. Rep. of Germany | 52/586 |

*Primary Examiner*—John E. Murtagh
*Assistant Examiner*—Mark J. Sofia
*Attorney, Agent, or Firm*—Hamilton, Brook, Smith & Reynolds

[57] ABSTRACT

The invention resides in a thermally insulated building panel comprising a laminate of exterior building material 8 with insulation 10 between them in which there are grooves 18 formed which extend lengthwise of an edge of the panel proximate the insulation engaging surfaces of the exterior and interior materials. The dimension of the open end O of a groove is greater than the dimension of its closed end 26 to facilitate entry into the groove of a spline 12 for joining two adjacent panels together.

3 Claims, 6 Drawing Figures

INSULATED BUILDING PANEL

DESCRIPTION

TECHNICAL FIELD

This invention is in the field of building materials.

BACKGROUND ART

As an improvement upon conventional building practices, where insulation in the form of batts or granular material is placed between framing members of a structure, this invention is directed to completely enclosing the structure with insulation. A prefabricated, thermally insulated panel is provided which comprises a lamination of exterior building material such as siding or sheathing, interior material such as drywall or finish board, with solid insulation permanently secured between them. By securing panels in abutting relationship to the complete exterior of the frame of both the walls and the roof, the entire interior of the structure is virtually within an envelope of insulating material. Furthermore, the use of solid or rigid insulating materials offers a wider choice of higher efficiency insulations than the more conventional flexible batts or particulate materials.

Laminated panels of this type are secured to the exterior of the structure by nailing. It is desirable to center the joint between adjacent panels on a beam, joist or rafter to permit both panels to be securely nailed close to their abutting edges. However, it is not always possible to do this. More often than not, the joint between adjacent panels occurs where there is no beam or stud and means must be provided to lock the panels together and to keep their surfaces in the same plane.

This is accomplished by interlocking two panels together with splines which run lengthwise of the butting edges of the two panels. A single spline engages the exterior siding and a second spline engages the interior drywall of the two abutting panels along their interior or insulation engaging surfaces, i.e. on the inside of the outer laminae of the panel. Screws are then driven through the exterior and interior laminae adjacent their edges and into the splines.

The splines are accommodated within grooves routed or milled out of the insulation material, half of one spline being accommodated in one panel and the other half of the spline being accommodated with a mating groove in the adjacent panel.

DISCLOSURE OF THE INVENTION

One of the problems involved with the prior art insulated panels is in balancing efficiency of construction, efficiency of insulation, and economy with regard to the materials involved. For example, the basic panel construction is extremely rigid and long lasting and the insulation more efficient per inch of thickness than conventional kinds. However, the splines are generally inexpensive furring strips or battens. They have often been stored in mill or lumber yards for lengthy periods of time and become warped and their surfaces splintery where the grain has been raised by exposure to the elements. This makes it difficult if not impossible to insert the splines into the grooves formed in the ends of the insulated panels.

Another problem is in avoiding inadvertent cutting or abrading of the outer and inner laminae or sheets which make up the panel, in particular the interior sheet which is generally drywall or other plaster-like material. If the drywall is cut or abraded in the process of milling or routing the grooves, the panels not only look unsightly in unassembled form but the problem of inserting the splines into the grooves is compounded because of the extra friction generated between a warped or rough surface spline and an abraded surface of plaster wallboard. The problem is compounded further if the interior sheathing is finish plywood. If the edges become grizzled in the milling process, the whole panel usually is considered unusuable, or at best, a second.

It is thus an object of this invention to overcome both of the problems without substantially increasing the cost of manufacturing the laminated panels and without changing the material from which either the panels or the splines are made.

This objective is accomplished by providing in a thermally insulated building panel comprising a laminate of exterior building material and interior building material with insulation between them, grooves in the insulation which extend lengthwise of an edge of the panel proximate the insulation engaging surfaces of the exterior and interior materials wherein the dimension of the open end of a groove is greater than the dimension of its closed end to facilitate entry into the groove of a spline for joining two adjacent panels together. The problem of eliminating the inadvertent abrasion of the interior skin or building material is accomplished by leaving a residue of insulation between the groove and the insulating engaging surface of the finish or interior sheathing nearest to it.

DESCRIPTION OF THE DRAWINGS

The above and other features of the invention, including various novel details of construction and combinations of parts, will now be more particularly described with reference to the accompanying drawings and pointed out in the claims. It will be understood that the particular building panels embodying the invention are shown by way of illustration only and not as a limitation of the invention. The principles and features of this invention may be employed in varied and numerous embodiments without departing from the scope of the invention.

BEST MODE OF CARRYING OUT THE INVENTION

Figure 1:
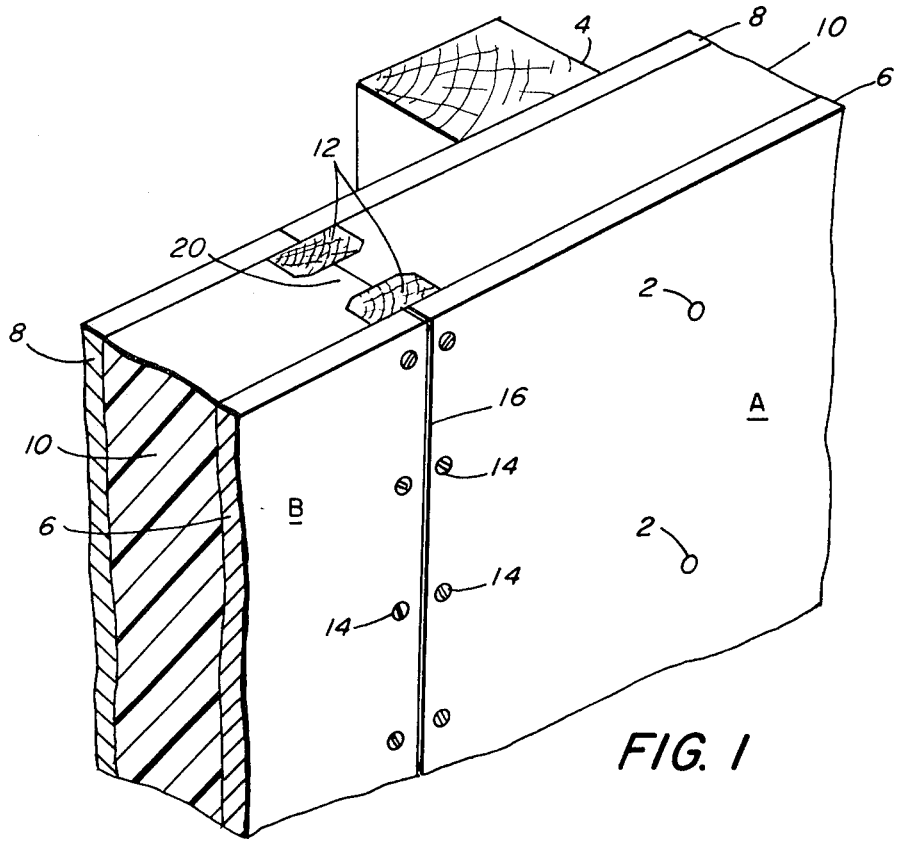
FIG. 1 is a perspective view of two adjacent building panels secured in abutting relationship.

In FIG. 1 there will be seen a portion of a wall or roof of a building structure made of thermally insulated building panels in which the present invention is embodied. Panel A is shown secured by nails 2 to a beam, stud or rafter 4. The panel comprises a laminate made up of a sheet of exterior building material 6 which may, for example, be 7/16 inch thick exterior plywood, particle board or any other equivalent material and a sheet of interior building material 8 which may be ½ inch thick drywall, plasterboard or finish plywood or the like.

Permanently sandwiched between the exterior and interior materials 6 and 8 is insulation 10 which may, for example, be 3½ inch thick foam plastic such as polyurethane having an R-value of 26.4. The laminates 6 and 8 are bonded firmly to the foam insulation by adhesive such as contact cement to prevent relative sliding motion.

A second Panel B is shown in FIG. 1 in butting relationship to Panel A, the panels being held securely together by splines 12 (the splines will be described in greater detail hereinafter) secured within the panels by fasteners 14 such as drywall screws. A gap 16 may be left in the exterior surface of two adjacent panels to receive caulking material.

Figure 2:
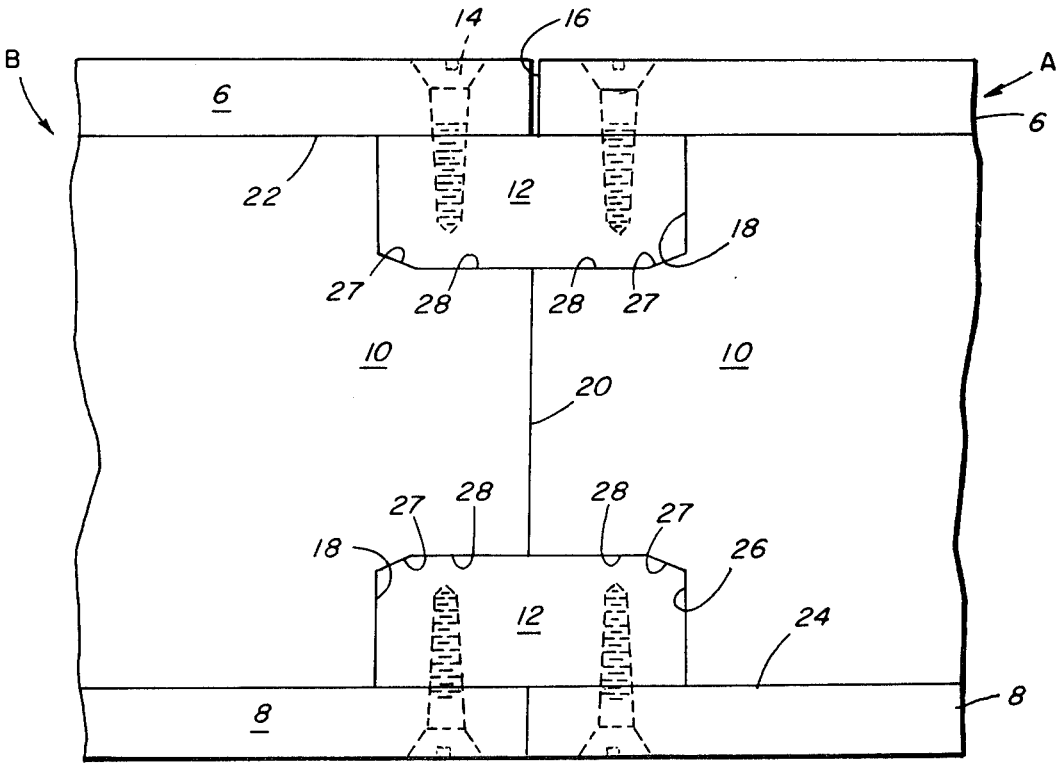
FIG. 2 is a top plan view in substantially full size of two insulated building panels secured together in abutting relationship in accordance with one aspect of the invention.

With reference to FIG. 2, the splines 12 fit into grooves 18 (also seen in alternative forms in FIGS. 3 and 4) milled one inch deep into the insulation 10. The grooves extend lengthwise of an edge or end 20. The grooves are located proximate the insulation engaging surfaces 22 and 24 of the exterior building material 6 and the interior building material 8 respectively. It will be seen that the dimension of the open end of a groove (seen best by the arrow designated "O" in FIGS. 3 and 4) is greater than the dimension of the closed end 26.

Figure 3:
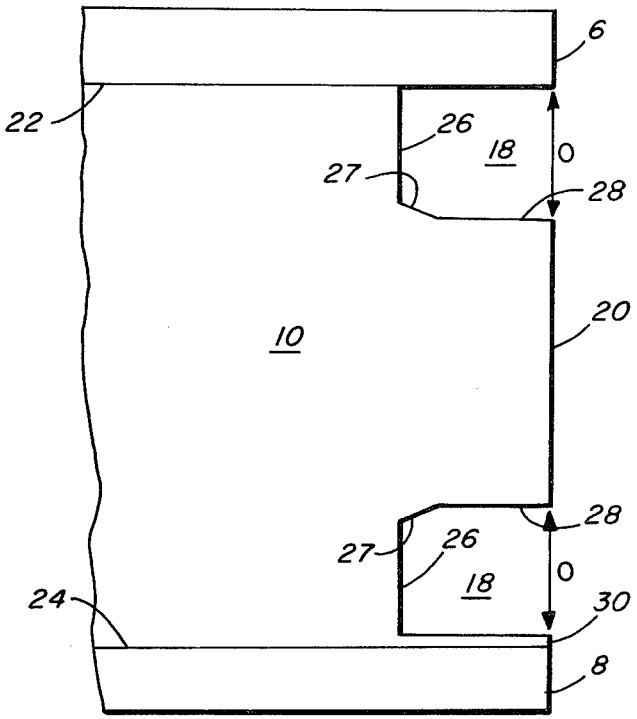
FIGS. 3 and 4 are each top plan views of building panels with the splines removed illustrating various features of the construction of the grooves.

With particular reference to FIG. 3, it will be seen that a rearward portion 27 of each 28 of the grooves which are farthest from the insulation engaging surfaces 22 and 24 of the exterior building material 6 and the interior material 8 is tapered for a distance of ¼ inch from the closed end 26 to the opened end. The dimension "O" is ¾ inch and the wall 26 is 11/16 inch. The amount of taper is 1/16 inch per inch of groove depth or approximately 14 degrees. This is to facilitate the entry of a spline 12 best seen in FIG. 5.

Figure 5:
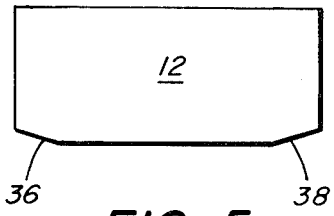
FIGS. 5 and 6 are end views of splines for use with panels having grooves as shown in FIGS. 2 and 3.

The spline seen in FIG. 5 has one side beveled at 36 and 38 to the same angle as the tapered portion 27 of the walls 28 and thus mates with the grooves 18 when assembled. The splines may be made slightly thicker or the bevel angle slightly greater to obtain a snug fit when the splines are pressed into the grooves. This prevents the splines from falling out of the grooves before they are screwed firmly in place.

With reference to FIG. 3, it will be seen that in the groove 18 nearest the plasterboard 8 there is a 1/6 inch residue of insulating material 30 between the groove and the foam engaging surface 24. This provides a number of advantages. First, it permits some degree of tolerance on the part of the operator who cuts the grooves in the foam material 10. Since the interior building material is often drywall or plasterboard, a white powder is produced when it is cut or abraded. This is to be avoided since it not only makes the panel look defective to one using it, but weakens it in an area which is critical, i.e., where it is to be screwed to the spline. Intentionally leaving a residue or insulating material by centering the cut more than half the slot width from the plasterboard eliminates these problems. Both grooves of the panel may have foam residues if desired.

Not only are the problems solved but a distinct advantage is gained. Since the foam insulating material is resilient, the residue, when the spline is screwed in place, provides a bed which will accomodate irregularities in the spline, which can be considerable over an 8 ft. length even though the spline has been beveled.

Figure 4:
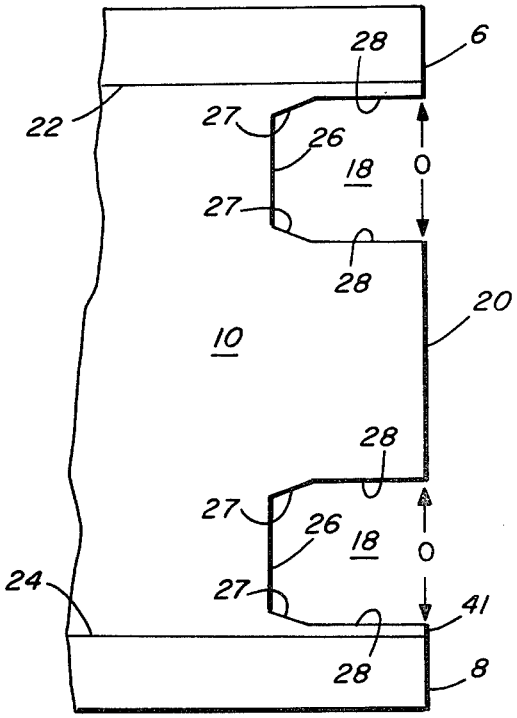

FIG. 4 illustrates a panel with both walls of the grooves having tapered portions 27 extending from the closed ends to the open ends. As in the FIG. 3 embodiment, a residue 41 of foam may be left adjacent to the surface 24 or, if desired, both grooves may have residues.

Figure 6:
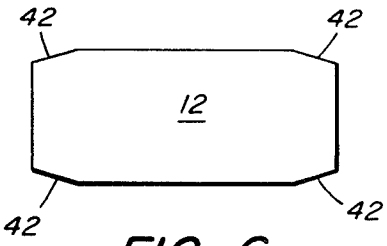

FIG. 6 shows a spline 12 having bevels 42, 44 at opposite sides to fit the grooves of the FIG. 4 panel.

In actual practice, referring again to FIG. 1, the panel A is nailed or otherwise secured to beam 4. If the edge 20 of the panel is spaced from the beam as shown in FIG. 1, a spline 12 of a type to fit the particular groove selected is pressed into each groove and secured by screws 14. It should be noted that the splines at this stage of the operation are actually tongues projecting from the ends of panel A. Next, panel B is tilted up against panel A with the then projecting splines 12 entering the grooves 18 of panel B. Because of the tapering of the grooves, aligning the panels is made much easier. When panel B is in place, the panels are secured firmly together by another set of screws 14 passing through the exterior and interior sheets 6 and 8 of panel B into the splines 12.

I claim:

1. A thermally insulated building structure comprising two butted panels each including a laminate of exterior building material and interior building material with solid insulation between them characterized by:

the exterior building material being shorter than the solid insulation creating a gap in the exterior surface to receive calking material;

a pair of complimentary grooves formed in the insulation of each panel which extend lengthwise of an edge of the panel proximate the inner surfaces of said exterior and interior building materials and exposing a portion of said surfaces, the walls of each groove being substantially parallel, a rearward portion of each groove is remote from an inner surface of said exterior and interior building materials having a taper which intersects the closed end of the groove to render the dimension of the open end of a groove greater than the dimension of its closed end, splines for joining the two adjacent panels together located half in each groove of a butted panel, each spline being tapered at one corner to facilitate its entering into the groove and to firmly mate with the taper at the closed end, screws inserted through the exterior and interior building materials directly into the splines to pull them toward the insulation engaging surfaces of the exterior and interior building material.

2. Building structure of claim 1 in which the insulation is foam plastic, the exterior material is particle board and the interior material is drywall.

3. Building structure according to claim 1 where there is a thin residue of insulating material between the grooves and the inner surfaces of the interior and exterior building material which forms a resilient bed to accommodate irregularities in the spline when it is inserted in the groove and pulled toward the interior surfaces of the exterior or interior building material by the screws.

* * * * *